US006366243B1

(12) United States Patent
Isohätälä et al.

(10) Patent No.: US 6,366,243 B1
(45) Date of Patent: Apr. 2, 2002

(54) PLANAR ANTENNA WITH TWO RESONATING FREQUENCIES

(75) Inventors: Anne Isohätälä, Kello; Kimmo Antila, Kiviniemi; Sauli Kivelä , Kuusamo; Jyrki Mikkola; Suvi Tarvas, both of Oulu, all of (FI)

(73) Assignee: Filtronic Lk Oy, Kempele (FI)

( * ) Notice: Subject to any disclaimer, the term of this patent is extended or adjusted under 35 U.S.C. 154(b) by 0 days.

(21) Appl. No.: 09/429,831

(22) Filed: Oct. 29, 1999

(30) Foreign Application Priority Data

Oct. 30, 1998 (FI) ..... 982366

(51) Int. Cl.[7] ..... H01Q 1/38
(52) U.S. Cl. ..... 343/700 MS; 343/702
(58) Field of Search ..... 343/700 MS, 702, 343/846, 767, 829, 769; H01Q 1/38

(56) References Cited

U.S. PATENT DOCUMENTS

| | | | | | |
|---|---|---|---|---|---|
| 4,072,951 | A | * | 2/1978 | Kaloi | 343/700 MS |
| 4,072,952 | A | * | 2/1978 | Demko | 343/700 MS |
| 4,238,800 | A | | 12/1980 | Newington | 343/715 |
| 4,899,164 | A | * | 2/1990 | McGrath | 343/754 |
| 5,241,322 | A | * | 8/1993 | Gegan | 343/700 MS |
| 5,400,041 | A | * | 3/1995 | Strickland | 343/700 MS |
| 5,926,139 | A | * | 7/1999 | Korisch | 343/702 |
| 6,040,803 | A | * | 3/2000 | Spall | 343/700 MS |
| 6,054,953 | A | * | 4/2000 | Lindmark | 343/700 MS |
| 6,140,966 | A | * | 10/2000 | Pankinaho | 343/700 MS |
| 6,229,487 | B1 | * | 5/2001 | Sadler et al. | 343/700 MS |

FOREIGN PATENT DOCUMENTS

| | | | |
|---|---|---|---|
| EP | 301 216 A2 | 7/1987 | H01Q/13/08 |
| EP | 484 454 B1 | 7/1990 | H01Q/1/24 |
| EP | 455 493 A2 | 11/1991 | H01Q/13/08 |
| WO | 91/02386 | 2/1991 | H01Q/1/24 |

OTHER PUBLICATIONS

Zi Dong Liu et al., "Dual–Frequency Planar Inverted–F Antenna," *IEEE Transactions of Antenna and Propag*, vol. 45, No. 10, Oct. 1997.

* cited by examiner

*Primary Examiner*—Don Wong
*Assistant Examiner*—Trinh Vo Dinh
(74) *Attorney, Agent, or Firm*—Darby & Darby

(57) ABSTRACT

A planar antenna comprises a planar radiating element (600) formed of a conductive area confined by a substantially continuous border line. The conductive area is split by a gap which divides the planar radiating element into a first branch and second branch such that both the first and the second branch have an outermost end. The gap has a head end on said substantially continuous border line and a tail end within the conductive area. At its head end (601) the gap has a certain first direction and at another point (603) a certain second direction which differs from the first direction by more than 90 degrees when the directions are defined along the gap from the head end towards the tail end. The outermost end of the second branch, confined by the gap, is located within the continuous border line, surrounded by the first branch.

10 Claims, 5 Drawing Sheets

Figure 4A:
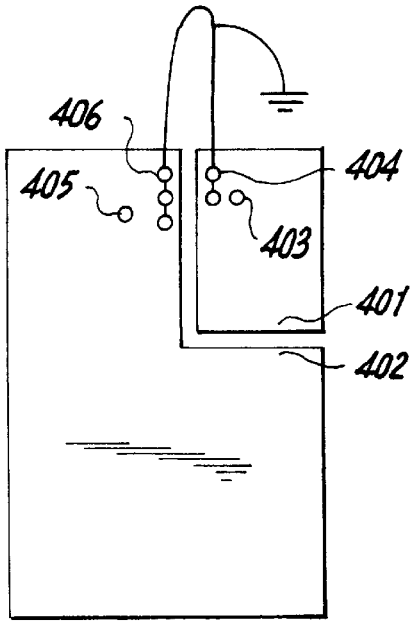
Fig. 4a (Prior Art)

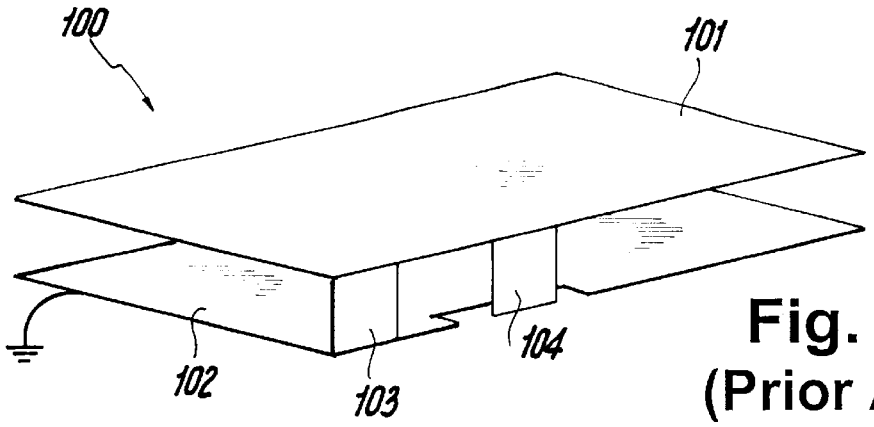
Fig. 1
(Prior Art)
Fig. 2
(Prior Art)
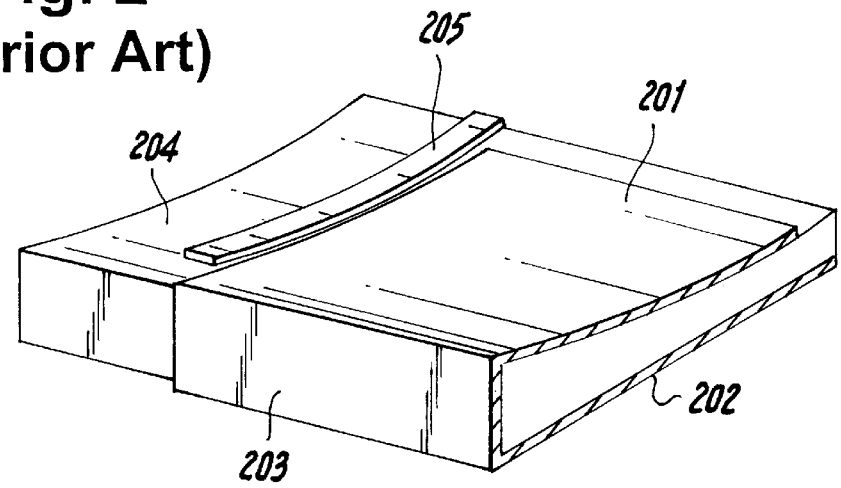
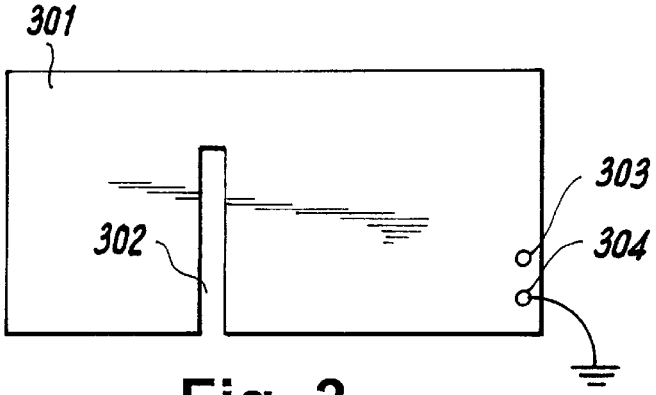
Fig. 3
(Prior Art)

PLANAR ANTENNA WITH TWO RESONATING FREQUENCIES

The invention relates in general to antenna structures in radio apparatuses. In particular the invention relates to a planar inverted-F antenna (PIFA) structure that has two resonating frequencies.

FIG. 1 shows a known basic model of a planar inverted-F antenna 100 comprising a planar electrically conductive radiating element 101, electrically conductive ground plane 102 parallel to said radiating element, and, connecting these two, a ground contact 103 which is substantially perpendicular to the radiating element and ground plane. The structure further includes a feed electrode 104 which also is substantially perpendicular to the radiating element and ground plane and which can be coupled to an antenna port (not shown) of a radio apparatus. In the structure of FIG. 1 the radiating element 101, ground contact 103 and the feed electrode 104 are usually manufactured by cutting a thin metal sheet into a suitable rectangular shape which has got two protrusions bent to a right angle. The ground plane 102 may be composed of a metallized area on the surface of a printed circuit board so that the ground contact 103 and feed electrode are easily connected to holes on the printed circuit board. The electrical characteristics of the antenna 100 are affected in general by the dimensions of its elements and in particular by the size of the radiating element 101 and its distance from the ground plane 102.

A disadvantage of the antenna structure depicted in FIG. 1 is its poor mechanical sturdiness. Various solutions have been proposed to this problem. European Patent document No. 484,454 discloses a PIFA structure according to FIG. 2 wherein a radiating element 201, ground plane 202 and a ground contact 203 connecting these two are realized as metal platings on surfaces of a solid dielectric body 204. The antenna is fed through a coupling element 205 which does not touch the radiating element 201. An electromagnetic coupling exists between the coupling element 205 and radiating element 201, and the coupling element extends over the edge of the dielectric body 204 to a point that can be coupled to the antenna port of a radio apparatus. The structure is mechanically sturdy, but the dielectric body block makes it rather heavy. Furthermore, the dielectric body makes the impedance bandwidth of the antenna narrower and degrades the radiation efficiency as compared to an air-insulated PIFA structure.

The radiating element of a planar inverted-F antenna need not be a simple rectangle as in FIGS. 1 and 2. FIG. 3 shows a known PIFA radiating element 301 design. The rectangular shape is broken by a gap 302 which forms a sort of strip in that portion of the radiating element which is farthest away from the feed point 303 and ground contact 304. The purpose of the gap usually is to increase the electrical length of the antenna and thus affect the antenna's resonating frequency.

All the PIFA structures described above are designed such that they have a certain resonating frequency as well as an operating frequency band centering round said resonating frequency. In some cases, however, it is preferable that the antenna of a radio apparatus have two different resonating frequencies. An example of such a case is a cellular radio system terminal which has to be capable of operating in two different cellular radio systems or in two different frequency ranges of a single cellular radio system. The difference of the frequencies may be considerable as at the moment of writing this patent application the frequency areas of currently existing cellular radio systems range from about 400 MHz to about 1900 MHz, and it is probable that even higher frequencies will be taken into use in the future.

Figure 4B:
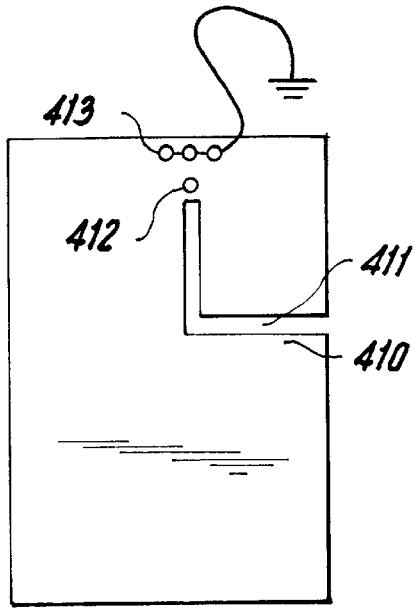
Fig. 4b (Prior Art)

FIGS. 4*a* and 4*b* show dual-frequency PIFA radiating elements known from the publication "Dual-Frequency Planar Inverted-F Antenna" by Z.D. Liu P.S. Hall, D. Wake, IEEE Transactions on Antennas and Propagation, Vol. 45, No. 10, October 1997, pp. 1451–1457. In FIG. 4*a* the antenna comprises a rectangle-shaped first radiating element 401 and a second radiating element 402 surrounding said first radiating element from two sides. The first radiating element has got a feed point 403 and ground contact 404 of its own, and the second radiating element has got those of its own, 405 and 406. In FIG. 4*b* the antenna comprises a continuous radiating element 410 which is split into two branches by a gap 411. The feed point 412 is located near the inner end of the gap 411 so that it can be said that the branches have different directions from the feed point on. Both branches have electrical lengths of their own which differ from each other considerably. The ground contacts 413 are located near the edge of the structure.

Figure 5:
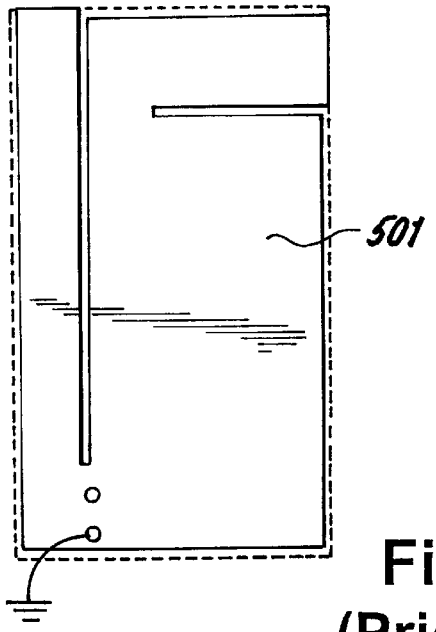
Fig. 5 (Prior Art)

It is further known a dual-frequency PIFA radiating element 501 according to FIG. 5 which has got two branches in the same manner as the radiating element in FIG. 4*b*. In FIG. 5, the outermost ends of both branches extend to the edge of the printed circuit board, depicted by the broken line, which supports the radiating element. This structure provides a somewhat wider antenna impedance band, i.e. frequency range around a particular resonating frequency in which the antenna impedance matching to the antenna port of the radio apparatus is good. At the same time, however, the SAR value, which represents the amount of radiation absorbed by the user, becomes rather high, especially in the higher frequency band.

An object of the present invention is to provide a planar antenna with at least two resonating frequencies. Another object of the present invention is that the planar antenna according to it can be tuned in a versatile manner. Yet another object of the invention is that the antenna according to it has a relatively low SAR value.

These and other objects of the invention are achieved by a planar antenna structure which has an outer branch and an inner branch such that the outermost end of the inner branch is for the most part surrounded by the outer branch.

The planar antenna according to the invention comprises a planar radiating element formed of a conductive area confined within a substantially continuous border line, said conductive area being split by a non-conductive gap which divides the planar radiating element into a first branch and second branch such that both the first and the second branch have an outermost end, and which has a head end at said sub-stantially continuous border line and a tail end within the conductive area. The planar antenna according to the invention is characterized in that at its head end the gap has a certain first direction and at another point of the gap it has a certain second direction which differs more than 90 degrees from the first direction when the directions are defined from the head end to the tail end of the gap, whereby the outermost end of the second branch, confined by the gap, is located within the continues border line, surrounded by the first branch.

The invention is also directed to a radio apparatus. It is characterized in that it comprises a planar radiating element like the one described above and a ground plane which is substantially parallel to said radiating element and located with respect to the planar radiating element such that in the typical operating position of the radio apparatus it is between the planar radiating element and the user of the radio apparatus.

The planar antenna according to the invention comprises a planar radiating element split into at least two branches by a gap. The electrical lengths of the branches are chosen such that the first branch efficiently operates as an antenna at a first operating frequency of the structure and, respectively, the second branch efficiently operates as an antenna at a second operating frequency of the structure. An advantageous method is to choose the electrical lengths such that the electrical length of each branch corresponds to a quarter of a wavelength at the desired operating frequency. The feed point and ground contact(s) of the antenna are preferably located near the point where the branches come together.

In order to minimize the SAR value the outermost end of the second branch is located such that it is not by the edge of the planar radiating element but is substantially surrounded by the first branch. It has proven advantageous that the second branch then is the branch corresponding to the higher operating frequency. The layout is brought about by shaping the gap at least in some parts strongly curvilinear so that the outermost end of the second branch remains on the concave side of the curved portion of the gap.

The electrical characteristics of the antenna structure strongly depend on the width and shape of the gap. It is usually advantageous to have rather a narrow gap so that the branches function as capacitive loads to each other. Capacitive loading decreases the resonating frequencies so that an antenna intended for certain particular frequency ranges can be made smaller than without said capacitive loading. In addition, the location and shape of the gap affects the ratio of the resonating frequencies of the antenna, as well as the bandwidth in both resonating frequency ranges.

In accordance with a preferred embodiment of the invention the gap is shaped such that at least the branch corresponding to the lower resonating frequency gets wider either in steps or steplessly towards its outermost end. A branch that gets wider towards its outer end facilitates a smaller radiating element without considerably compromising the radiation or impedance bandwidth.

Figure 6:
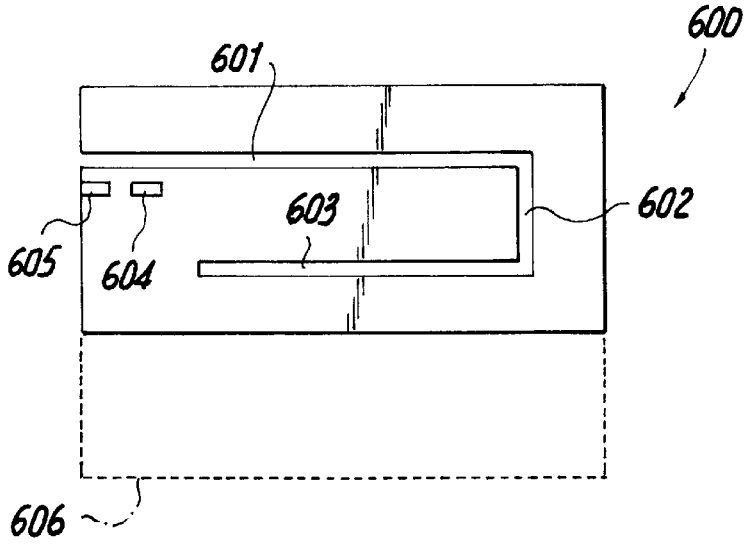
Figure 7:
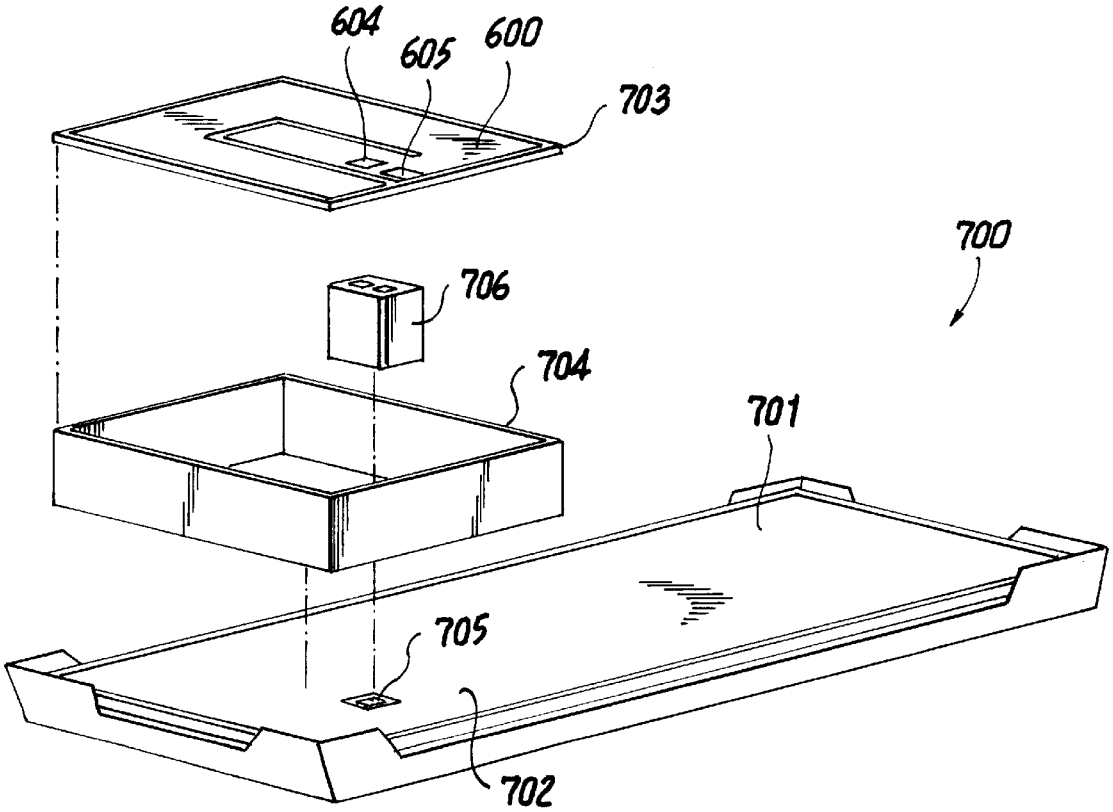

The invention will now be described in more detail with referent to the preferred embodiments presented by way of example and to the accompanying drawings wherein FIG. 1 shows the basic PIFA structure known in the art, FIG. 2 shows a PIFA structure known in the art, FIG. 3 shows a known planar radiating element design, FIGS. 4*a*, 4*b* show known dual-frequency planar radiating element designs, FIG. 5 shows a known dual-frequency planar radiating element design, FIG. 6 shows a planar radiating element design according to the invention, FIG. 7 shows an advantageous location of the planar radiating element according to FIG. 6 in a radio apparatus, and FIGS. 8*a* to 8*k* show alternative planar radiating element designs according to the invention.

Above in conjunction with the description of the prior art reference was made to FIGS. 1 to 5, so below in the description of the invention and its preferred embodiments reference will be made mainly to FIGS. 6 through 8*k*. Like elements in the drawings are denoted by like reference designators.

FIG. 6 shows a planar radiating element 600 which is substantially shaped like a continuous rectangle. A dividing gap starts from a point on the edge of the rectangle and is directed inside the planar radiating element, at first perpendicular to the edge of the radiating element. This straight portion can be called the first portion 601 of the gap. The second portion 602 of the gap is at an angle of 90 degrees with the first portion and is directed downwards with respect to the position shown in the drawing. The third portion 603 of the gap is again at an angle of 90 degrees with the second portion, i.e. parallel to the first portion; if, however, the directions of the portions are defined from the start point of the gap towards its end, the third portion is at an angle of 180 degrees with the first portion.

The planar radiating element 600 divided by the gap resembles an angular, horizontally mirrored letter G, wherein the feed point 604 and ground contact 605 are located near the outer end of the horizontal portion of the G. From the point of view of the invention it is not essential where in the radiating element the feed point and ground contact are located, but their location affects the dimensions of the branches of the radiating element. The electrical length of each branch is in a certain proportion to its physical dimensions, especially to the distance between the ground contact and the outermost end of the branch, measured along the center line of the branch. In the structure according to FIG. 6 where the branches are in fact the first and second ends of one and the same conductive strip of a given non-varying width, the junction of the branches is defined as the point where the feed point and ground contact(s) are located. FIG. 6 also shows, in broken line, the lower part of the ground plane 606. Advantageously the ground plane is at least in one direction somewhat bigger than the planar radiating element, located parallely with the radiating element and extending in said one direction farther than the radiating element. In this kind of a structure, the branch corresponding to the lower resonating frequency of the planar radiating element is advantageously located such that its outermost edge is near to the edge of the ground plane. So, it would be disadvantageous to have the planar radiating element according to FIG. 6 mirrored vertically such that the outer end of the branch corresponding to the lower resonating frequency would end up on that side where the ground plane 606 extends considerably farther than the radiating element.

FIG. 7 shows an advantageous arrangement for providing an antenna structure in a radio apparatus wherein the radiating antenna element is a planar radiating element according to FIG. 6. By way of example, the radio apparatus is in this case a mobile phone 700 shown in the drawing the exterior case opened such that the keypad, display and loudspeaker, which are known to be found in a mobile phone, are facing down and therefore not shown. A first printed circuit board 701 or another substantially planar surface inside the mobile phone comprises a ground plane 702 which is a substantially continuous electrically conductive area. The ground plane formed on the printed circuit board may be located on the surface of the printed circuit board or in an intermediate layer of the printed circuit board. The planar radiating element 600 is formed on the surface of a second printed circuit board 703 which is attached to the first printed circuit board by means of a frame 704. A connection is provided from the feed point 604 to the antenna port 705 of the radio apparatus via a separate connector piece 706. The connection may require a leadthrough in printed circuit board 703. In this embodiment the same connector piece connects the ground contact 605 to the ground plane 702.

From the point of view of the invention it is irrelevant how the planar radiating element in the antenna structure is attached to the radio apparatus, so in this respect FIG. 7 has to be understood to be exemplary only. However, the ground plane 702 must exist in some form or another and it must be parallel or almost parallel to the planar radiating element 600 to produce a PIFA structure.

FIG. 7 shows that since the outermost end of the second antenna branch is located in the middle part of the planar radiating element, surrounded by the first branch, it is not close to any edge of the ground plane 702 when assembled. This arrangement will reduce the SAR value as in the normal operating position of the mobile phone the ground plane will be located between the radiating antenna element and the user's head and as the ground plane covers—viewed from the outermost end of the second branch—a very large sector in the direction of the user's head. The electric field is at its greatest at the outermost end of the branch corresponding to the higher operating frequency. It is advantageous to reduce the SAR value because all radiation absorbed in the user is wasted from the point of view of radio communication and thus degrades the signal-to-noise ratio.

FIGS. 8*a* to 8*k* show various alternative planar radiating element designs. The invention is not limited to the designs shown; rather, they are included mainly to illustrate the various application possibilities of the invention. All designs can also be realized mirrored with respect to any straight line or point. The locations of the feed point and ground contact are interchangeable, and they can also be located elsewhere. The exemplary location of the feed point is marked 801 in all figures, and the exemplary location of the ground contact is marked 802.

Figure 8A:
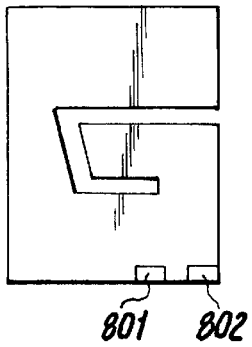
Figure 8B:
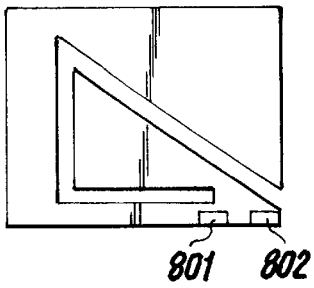
Figure 8C:
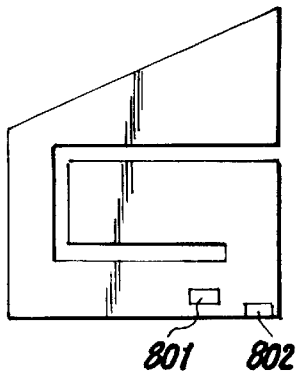
Figure 8D:
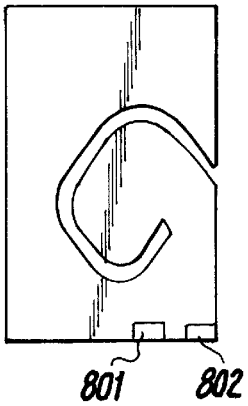
Figure 8E:
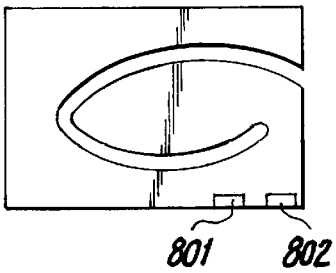
Figure 8F:
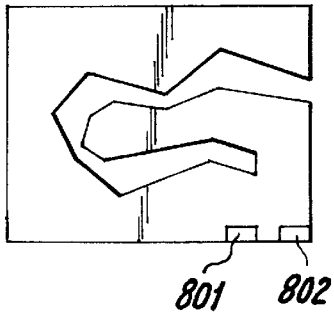
Figure 8G:
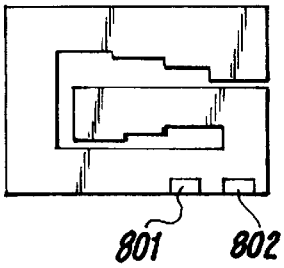
Figure 8H:
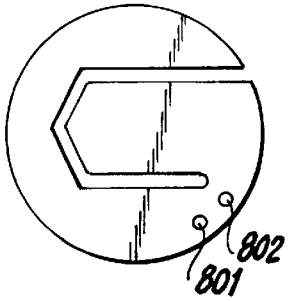
Figure 8I:
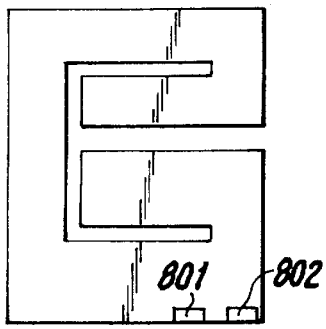

FIG. 8*a* shows an embodiment of the invention which complies with the same principle as the embodiment depicted in FIGS. 6 and 7, but in which the start point of the gap is located on the long side of the rectangle confirming the planar radiating element, and in which the angles of the gap are not right angles. In FIG. 8*b* both branches of the planar radiating element become continuously wider from a certain narrower point on towards the outermost end. With this kind of an arrangement it is possible to realize a somewhat smaller antenna, without the radiation or impedance bandwidth becoming considerably narrower, because the radiating antenna element is at its widest where the electric field is the greatest, i.e. at the open ends of the branches. FIG. 8*c* shows a variant of this structure where the basic shape of the planar radiating element is not a rectangle and where only the end of the branch corresponding to the lower operating frequency becomes wider. In addition, in FIG. 8*c* the feed point is located somewhere else than by the edge of the planar radiating element; this property is naturally applicable in the other embodiments as well. In the embodiment of FIG. 8*d* the gap is not comprised of straight segments but of a continuous curved portion. In the embodiment of FIG. 8*e*, too, the gap is curved but has its start point on the short side of the rectangle which serves as the basic shape. In the embodiment of FIG. 8*f* the width of the gap is not constant throughout but includes portions that become narrower and wider in a stepless fashion. In FIG. 8*g* the width of the gap changes in steps. In FIG. 8*h* the basic shape of the planar radiating element is not rectangular but circular. In FIG. 8*i* the gap branches out so that the outermost end of the first branch also ends up in the middle portion of the radiating element, away from the vicinity of its edges.

Figure 8J:
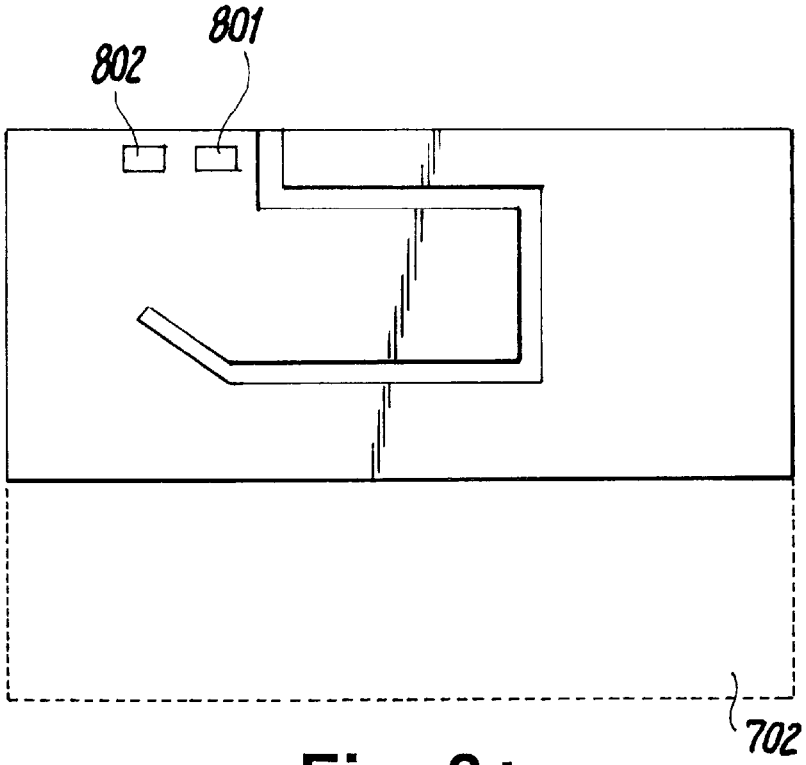
Figure 8K:
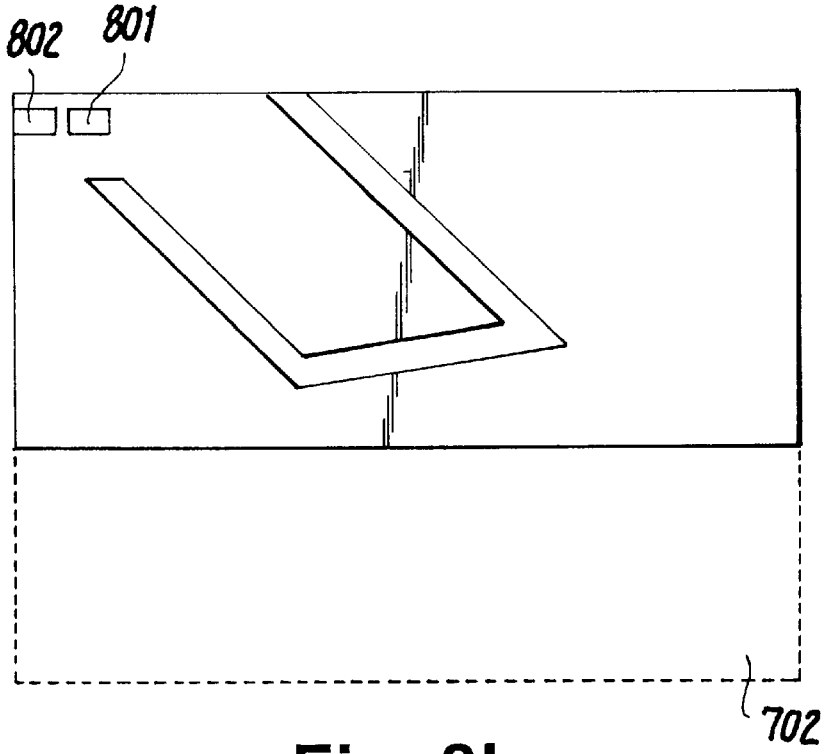

Furthermore, FIGS. 8*j* and 8*k* illustrate how on one side the ground plane 702 extends considerably farther than the planar radiating element. FIGS. 8*j* and 8*k* show planar radiating element designs that have proven very efficient in practice.

If the shape of the gap is very irregular, it may be difficult to perceive where the outermost ends of the branches are located. For such situations a general definition is applicable, which says that the outermost end of a branch is that farthest point from the feed point where a local electric field maximum is generated when the antenna is used.

Tuning of the antenna structure according to the invention, i.e. the selection of operating frequencies and bandwidths preferably performed by choosing a suitable gap shape. The longer the gap, the greater the electrical lengths of the branches confined by it, i.e. the lower the operating frequencies of the antenna structure. The antenna may even be manufactured such that the gap is initially a little too short so that the operating frequencies are a little higher than desired, and the gap is extended by removing conductive material from its end, at the same time measuring continually the characteristics of the antenna, whereby the operating frequencies can be set just right. Above it was already stated that the gap is preferably relatively narrow so that the branches act as capacitive loads to each other, thus decreasing the operating frequencies. This phenomenon can be utilized such that if the operating frequencies of an antenna are to be increased, conductive material is removed from the edge of the gap. Usually, however, widening the gap also increases the ratio of the frequencies, i.e. the higher operating frequency increases relatively more than the lower one. At the same time, the bandwidth at the higher operating frequency usually decreases and the bandwidth at the lower operating frequency increases. A suitable detailed shape and location of the gap can be found by experimenting.

The invention is not limited to the exemplary embodiments described above but it can be modified within the scope defined by the claims set forth below. For example, the planar radiating element may be curved in the same way as in the prior-art planar antenna depicted in FIG. 2. The invention finds particular utility in compact, portable radio apparatuses which have a certain typical operating position, which is known in advance, because then the locations of the planar radiating element and ground plane in the radio apparatus can be chosen such that the SAR value is minimal in the typical operating position. The operating frequencies which the antenna is dimensioned for are preferably from a few hundred megahertz to a few thousand megahertz.

What is claimed is:

1. A planar antenna comprising a planar radiating element (600) which is formed of a conductive area confined by a substantially continuous border line and split by a non-conductive gap which divides the planar radiating element into a first branch and second branch such that both the first branch and the second branch have respective outermost ends, an outermost end being defined as that part of a branch that is the electrically farthest point from a feed point where a local electric field maximum is generated when said antenna is in use, said gap has a head end on said substantially continuous border line and a tail end within the conductive area, the antenna operating in two frequency bands characterized in that at said head end (601) the gap has a certain first direction and at said tail end (603) a certain second direction which differs from the first direction by more than 90 degrees when the directions are defined along the gap from the head end towards the tail end, whereby the outermost end of the second branch confined by the gap, is located within the continuous border line surrounded by the first branch.

2. The planar antenna of claim 1, characterized in that said planar radiating element is a conductive pattern formed on the surface of a dielectric board (703).

3. The planar antenna of claim 1, characterized in that the gap consists of three straight portions (601, 602, 603) such that the direction of the first portion (601) differs from the direction of the third portion (603) by 180 degrees.

4. The planar antenna of claim 1, characterized in that the planar radiating element comprises a feed point (604, 801) and ground contact (605, 802) such that the electrical length from the feed point to the outermost end of the first branch is considerably greater than the electrical length from the feed point to the outermost end of the second branch.

5. The planar antenna of claim 1, characterized in that the width of the gap is different at various points of the gap.

6. The planar antenna of claim 1, characterized in that the width of at least one branch is different at various points of the branch.

7. The planar antenna of claim 6, characterized in that the width of said at least one branch increases towards its outermost end.

8. The planar antenna of claim 7, characterized in that the widths of both the first and the second branch increase towards the outermost ends of the respective branches.

9. The planar antenna of claim 1, characterized in that the outermost end of the first branch, too, is located within the continuous border line.

10. A radio apparatus (700) which has a typical operating position and which comprises a planar radiating element (600) as an antenna, said radiating element being formed of a conductive area confined by a substantially continuous border line and split by a non-conductive gap which divides the planar radiating element into a first branch and second branch such that both the first branch and the second branch have respective outermost ends, an outermost end being defined as that pat of a branch that is the electrically farthest point from a feed point where a local electric field maximum is generated when said antenna is in use, said gap has a head end on said substantially continuous border line and a tail end within the conductive area, the antenna operating in two frequency bands characterized in that at said head end (601) the gap has a certain first direction and at said tail end (603) a certain second direction which differs from the first direction by more than 90 degrees when the directions are defined along the gap from the head end towards the tail end, whereby the outermost end of the second branch, conied by the gap, is located within the continuous border line, surrounded by the first branch, and the radio apparatus comprises a ground plane (702) substantially parallel to the planar radiating element, located such that in said typical operating position it is between the planar radiating element and the user of the radio apparatus.

* * * * *